US011178909B2

(12) United States Patent
Liu

(10) Patent No.: US 11,178,909 B2
(45) Date of Patent: Nov. 23, 2021

(54) ELECTRONIC CIGARETTE WITH SHORT CIRCUIT PREVENTION

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 162 days.

(21) Appl. No.: 16/664,976

(22) Filed: Oct. 28, 2019

(65) Prior Publication Data

US 2020/0359705 A1 Nov. 19, 2020

(30) Foreign Application Priority Data

May 13, 2019 (CN) ..... 201910394348.6

(51) Int. Cl.
*A24F 40/10* (2020.01)

(52) U.S. Cl.
CPC ..... *A24F 40/10* (2020.01)

(58) Field of Classification Search
CPC ..... A24F 40/00; A24F 40/10; A24F 40/40
USPC ..... 131/328, 329
See application file for complete search history.

(56) References Cited

U.S. PATENT DOCUMENTS

2016/0050975 A1* 2/2016 Worm ..... A24F 40/95 131/328
2017/0181471 A1* 6/2017 Phillips ..... A61M 11/042
2017/0311646 A1* 11/2017 Liu ..... A24F 40/40
2018/0020738 A1* 1/2018 Qiu ..... A24F 40/51 131/329
2018/0070638 A1* 3/2018 Qiu ..... H02J 7/32
2018/0177958 A1* 6/2018 Wilder ..... A24F 40/46

* cited by examiner

*Primary Examiner* — Hae Moon Hyeon
(74) *Attorney, Agent, or Firm* — Matthias Scholl P.C.; Matthias Scholl

(57) ABSTRACT

An electronic cigarette, including: a seal cover; a housing; a silicone seal; a limit cover; a heating wire; a fixed seat; a fixed tube; a battery; a silicone sleeve; a plate including a pneumatic switch; and a plug. The housing includes a first part and a second part. The first part includes a curved airway filled with memory foam. The second part includes a first cavity and a second cavity arranged side by side. The silicone seal, the limit cover, the heating wire, the fixed seat, and the fixed tube are disposed in the first cavity of the housing. The battery, the silicone sleeve, the plate, and the plug are disposed in the second cavity of the housing. The heating wire and the fixed tube are disposed on the fixed seat, and the heating wire includes a pin embedded in the fixed tube.

1 Claim, 3 Drawing Sheets

ELECTRONIC CIGARETTE WITH SHORT CIRCUIT PREVENTION

CROSS-REFERENCE TO RELATED APPLICATIONS

Pursuant to 35 U.S.C. § 119 and the Paris Convention Treaty, this application claims foreign priority to Chinese Patent Application No. 201910394348.6 filed May 13, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid.

Conventionally, the atomizing unit and the battery are disposed in one cavity. This leads to the risk of the e-liquid coming into direct contact with the battery.

SUMMARY

The disclosure provides an electronic cigarette.

The electronic cigarette comprises a seal cover; a housing; a silicone seal; a limit cover; a heating wire; a fixed seat fixing the heating wire; a fixed tube; a battery; a silicone sleeve; a plate comprising a pneumatic switch; and a plug.

The housing comprises a first part and a second part integrated with the first part; the first part comprises a curved airway filled with memory foam; the second part comprises a first cavity and a second cavity arranged side by side; the silicone seal, the limit cover, the heating wire, the fixed seat, and the fixed tube are disposed in the first cavity of the housing; the battery, the silicone sleeve, the plate, and the plug are disposed in the second cavity of the housing; the heating wire and the fixed tube are disposed on the fixed seat, and the heating wire comprises a pin embedded in the fixed tube; the silicone seal sleeves the limit cover; the limit cover comprises a groove; the heating wire comprises a head fixed in the groove; the limit cover is in threaded connection to the fixed seat; the pin of the heating wire extends to the plate; the silicone sleeve sleeves the plate, and the plate is fixed on the battery; and the plug is disposed on one end of the housing.

DETAILED DESCRIPTION

Figure 1:
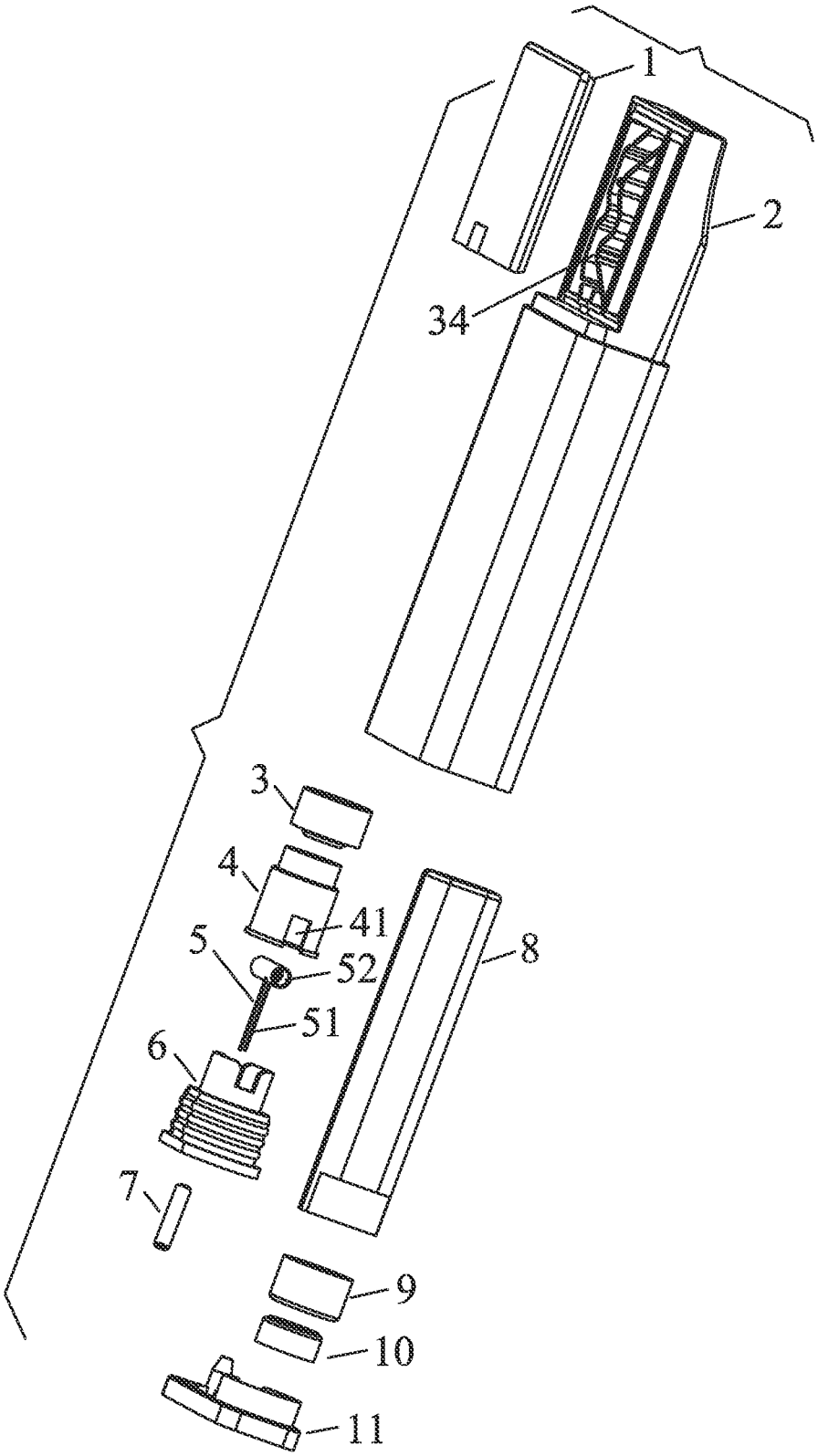
FIG. 1 is an exploded view of an electronic cigarette according to one embodiment of the disclosure.
Figure 2:
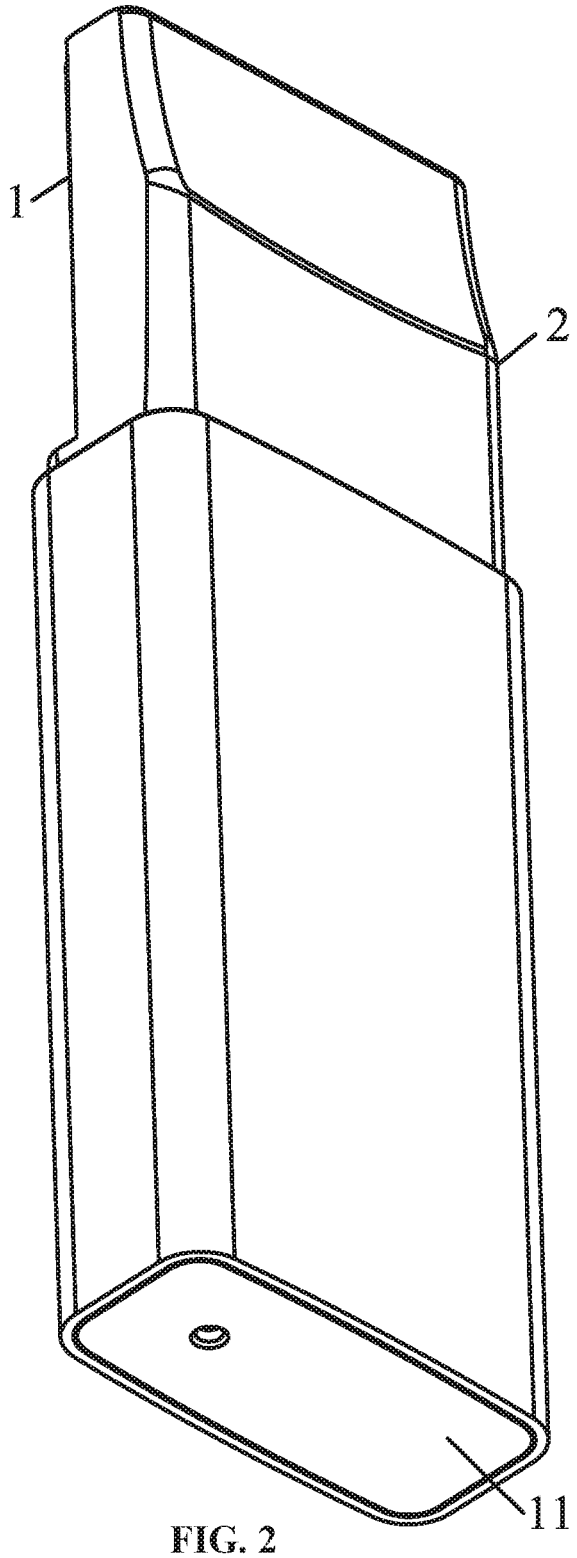
FIG. 2 is a schematic diagram of an electronic cigarette according to one embodiment of the disclosure.
Figure 3:
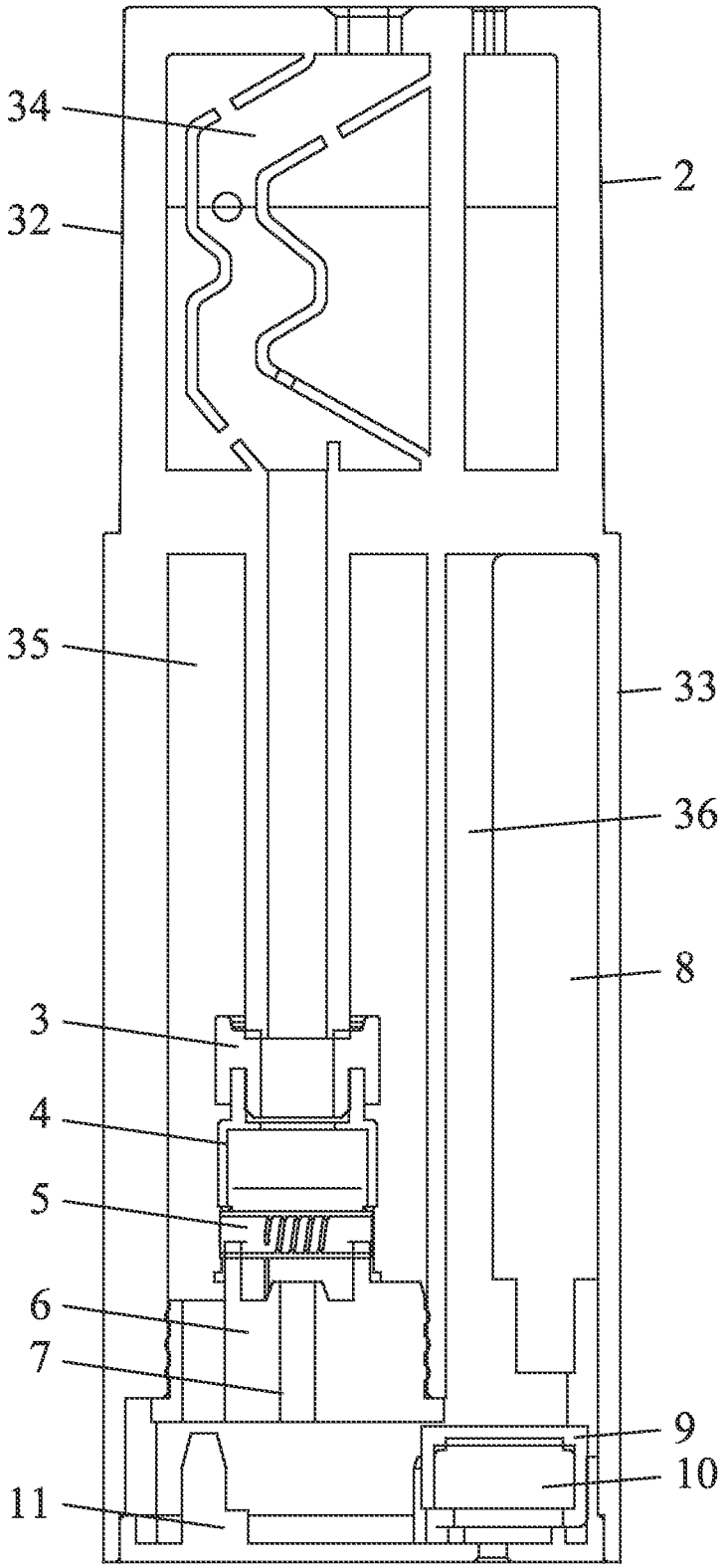
FIG. 3 is a sectional view of an electronic cigarette according to one embodiment of the disclosure.

To further illustrate, embodiments detailing an electronic cigarette are described below. It should be noted that the following embodiments are intended to describe and not to limit the disclosure.

An electronic cigarette comprises a seal cover 1; a housing 2; a silicone seal 3; a limit cover 4; a heating wire 5; a fixed seat 6 fixing the heating wire; a fixed tube 7; a battery 8; a silicone sleeve 9; a plate 10 comprising a pneumatic switch; a plug 11.

The reservoir housing 2 comprises a first part 32 and a second part 33 integrated with the first part 32; the first part 32 comprises a curved airway 34 filled with memory foam; the second part 33 comprises a first cavity 35 and a second cavity 36 arranged side by side; the silicone seal 3, the limit cover 4, the heating wire 5, the fixed seat 6, and the fixed tube 7 are disposed in the first cavity 35 of the reservoir housing 2; the battery 8, the silicone sleeve 9, the support plate 10, and the plug cover 11 are disposed in the second cavity 36 of the reservoir housing 2; the heating wire 5 and the fixed tube 7 are disposed on the fixed seat 6, and the heating wire 5 comprises a pin 51 embedded in the fixed tube 7; the silicone seal 3 sleeves the limit cover 4; the limit cover 4 comprises a groove 41; the heating wire 5 comprises a head 52 fixed in the groove 41; the limit cover 4 is in threaded connection to the fixed seat 6; the pin 51 of the heating wire 5 extends to the support plate 10; the silicone sleeve 9 sleeves the support plate 10, and the support plate 10 is fixed on the battery 8; and the plug cover 11 is disposed on one end of the reservoir housing 2.

The heating wire and the battery are disposed in two separated cavities, thus preventing the e-liquid from flowing into the battery or the plate comprising the pneumatic switch and avoiding the occurrence of the short circuit.

The electronic cigarette comprises a curved airway filled with memory foam, so that the produced vapor is filtered.

It will be obvious to those skilled in the art that changes and modifications may be made, and therefore, the aim in the appended claims is to cover all such changes and modifications.

What is claimed is:

1. An electronic cigarette, comprising:

1) a seal cover;
2) a reservoir housing;
3) a silicone seal;
4) a limit cover;
5) a heating wire;
6) a fixed seat fixing the heating wire;
7) a fixed tube;
8) a battery;
9) a silicone sleeve;
10) a support plate; and
11) a plug cover;

wherein:

the seal cover is disposed on the reservoir housing;

the reservoir housing comprises a first part and a second part integrated with the first part;

the first part comprises a curved airway; the second part comprises a first cavity and a second cavity arranged side by side;

the silicone seal, the limit cover, the heating wire, the fixed seat, and the fixed tube are disposed in the first cavity of the reservoir housing;

the battery, the silicone sleeve, the support plate, and the plug cover are disposed in the second cavity of the reservoir housing;

the heating wire and the fixed tube are disposed on the fixed seat, and the heating wire comprises a pin embedded in the fixed tube;

the silicone seal sleeves the limit cover; the limit cover comprises a groove; the heating wire comprises a head fixed in the groove;

the limit cover is connected to the fixed seat;

the silicone sleeve sleeves the plate, and the plate is fixed on the battery; and the plug cover is disposed on one end of the reservoir housing.

* * * * *